United States Patent [19]

Orlandini

[11] Patent Number: 4,878,776

[45] Date of Patent: Nov. 7, 1989

[54] BINDER FOR TELEPHONE DIRECTORIES AND THE LIKE

[76] Inventor: George Orlandini, 166 Brentwood La., Fairport, N.Y. 14450

[21] Appl. No.: 321,425

[22] Filed: Mar. 9, 1989

[51] Int. Cl.[4] ..... B42F 11/02

[52] U.S. Cl. ..... 402/4; 281/16; 281/47; 283/34; 283/56; 402/22; 402/73

[58] Field of Search ..... 281/16, 29, 47, 51; 283/34, 56; 402/4, 22, 73, 80 P

[56] References Cited

U.S. PATENT DOCUMENTS

| | | | |
|---|---|---|---|
| 473,703 | 4/1892 | Kheiralla et al. | 283/34 |
| 512,882 | 1/1894 | Hillhouse | 283/34 |
| 533,437 | 2/1895 | Clay | 281/16 |
| 1,693,865 | 12/1928 | Price | 281/16 |
| 1,696,629 | 12/1928 | Fenno | 281/34 |
| 2,316,786 | 4/1943 | Gottlieb | 283/34 X |
| 3,159,411 | 12/1964 | McKowen | 281/25 |
| 3,175,847 | 3/1965 | McKowen | 281/36 |
| 3,242,596 | 3/1966 | Smith | 281/16 X |
| 3,612,709 | 10/1971 | Miyamoto | 402/80 PX |
| 3,752,767 | 3/1971 | Learned et al. | 281/34 |
| 4,274,659 | 6/1981 | D'Ambrosio | 281/34 |
| 4,355,822 | 10/1982 | McHugh | 281/34 |
| 4,527,814 | 7/1985 | Carter et al. | 281/31 |
| 4,605,245 | 8/1986 | Weaver | 281/34 |

FOREIGN PATENT DOCUMENTS

| | | | |
|---|---|---|---|
| 783401 | 4/1968 | Canada | 281/16 |
| 1958027 | 6/1970 | Fed. Rep. of Germany | 281/47 |
| 54336 | 3/1967 | German Democratic Rep. | 281/47 |

*Primary Examiner*—Paul A. Bell

*Attorney, Agent, or Firm*—Henderson & Sturm

[57] ABSTRACT

A binder for a telephone directory or the like has a spine and top and bottom covers adapted to overlie the top and bottom faces of the directory. The binder is attached to the directory and the improvement resides in one or more auxiliary sheets, each folded in accordion fashion and carried by the binder inside the top cover so as to lie, in folded mode between the binder top cover and the directory top face. When the binder is open, the sheets can be unfolded to extend outwardly to present an area several times that of any page in the directory and is thus adapted to carry indicia in addition to the listings in the directory. The sheet or sheets are carried by a channel element attached to the inside of one of the binder covers.

9 Claims, 2 Drawing Sheets

BINDER FOR TELEPHONE DIRECTORIES AND THE LIKE

BACKGROUND AND SUMMARY OF THE INVENTION

It is known to provide covers for telephone directories and to show on such covers advertisements of businesses additional to those in the directory listings. The advertisements are usually those of businesses in the locality of the directory subscriber. The size of the covers limits the number of such businesses.

According to the present invention, an improved binder is provided having auxiliary means disposed inside the binder cover and adapted to carry supplementary sheets, each normally folded in accordion fashion between a cover of the binder and the adjacent face of the directory per se. When the binder is opened, the sheets are unfolded outwardly and provide an area several times that of any page in the directory, thus enabling the use of a greater number of auxiliary listings, advertisements, etc. A tab is carried by the free edge of each sheet so that it may be conveniently grasped to unfold the sheet. The sheet has one edge attached to the binder along a novel mounting means in the form of a channel parallel to the folds in the sheet so as to facilitate use of the sheet as an adjunct to the directory. The channel is flexible at one side so it can be opened to receive additional sheets and snap means is provided to secure the sheets in the channel and to keep the channel closed.

Other features of the invention will appear as a preferred embodiment is disclosed herein.

DETAILED DESCRIPTION OF A PREFERRED EMBODIMENT OF THE INVENTION

Figure 1:
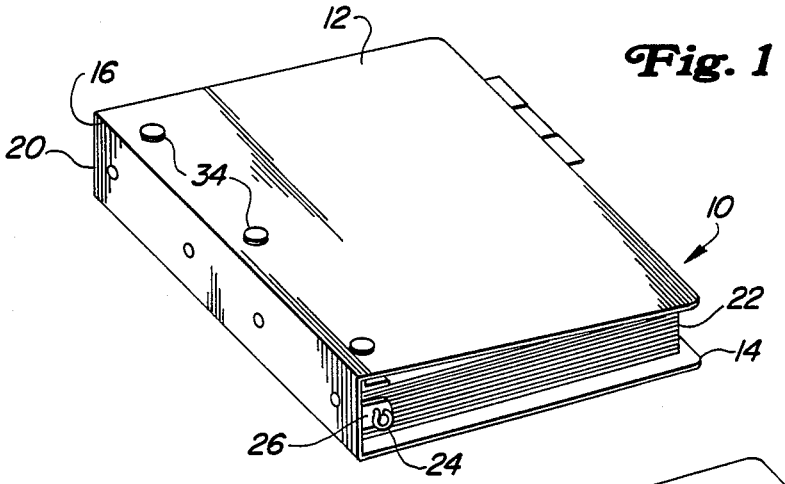
FIG. 1 is a perspective of the improved binder in closed condition.

The numeral (10) designates a binder having top and bottom, preferably hard covers (12) and (14), respectively, hinged at (16) and (18), respectively, to a spine or back (20). FIG. 1 shows that the binder may contain, for example, a typical telephone directory (22) retained by a rod (24) that "splits" the directory at its center and that is detachably connected to the interior of the binder spine by ears (26). See FIG. 2, which shows that the directory has been removed to better show the rod and ears. Retention of the directory or the like by the rod and ear arrangement is known per se. The ears are part of a metal strip (28) riveted to the spine at (30).

Figure 3:
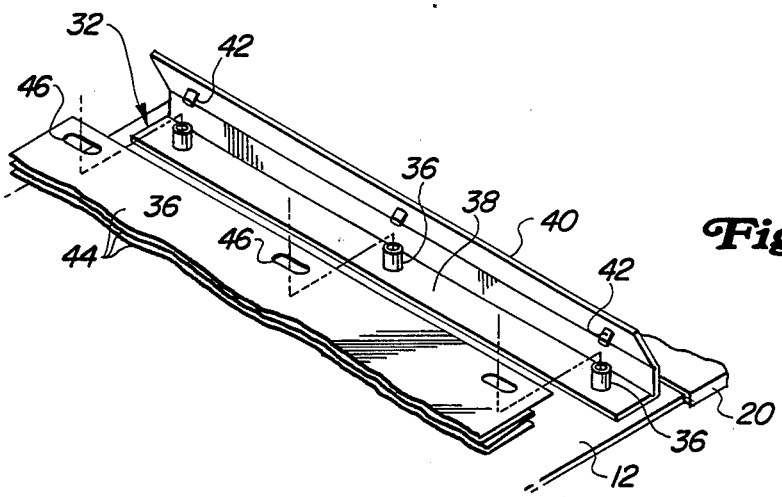
FIG. 3 is an enlarged perspective of the improved supplemental page attachment.

The invention resides in the provision of auxiliary means for holding a plurality of supplemental sheets which may contain specific information in addition to or in abbreviated repetition of data listed in the directory, all in the interests of providing quick and easy reference to commonly called businesses, etc. To this end, the auxiliary means is in the form of a channel (32) lying lengthwise along the inside face of the top cover (12) in parallelism with the spine (20). The means securing the channel in place here comprise fasteners having heads (34) (FIG. 1) on tubular parts (36) which pass through the cover (12) and through the lower flange (38) of the channel. The channel is made of such material—e.g., a suitable known plastic—that its upper flange (40) is hinged for selective movement between open and closed modes, the open mode being shown in FIG. 3. The under side of this upper flange has affixed thereto a plurality of pegs (42) respectively receivable in the tubular rivet parts (36) for the purpose of retaining a plurality of supplemental sheets (44) which have holes (46) for receipt by the parts (36)/(42) whereby the sheets are removably carried by the channel when the upper flange of the channel is pressed down to snap the pegs into the tubular parts (36). The channel may be easily opened to provide for the addition or removal of sheets.

Figure 4:
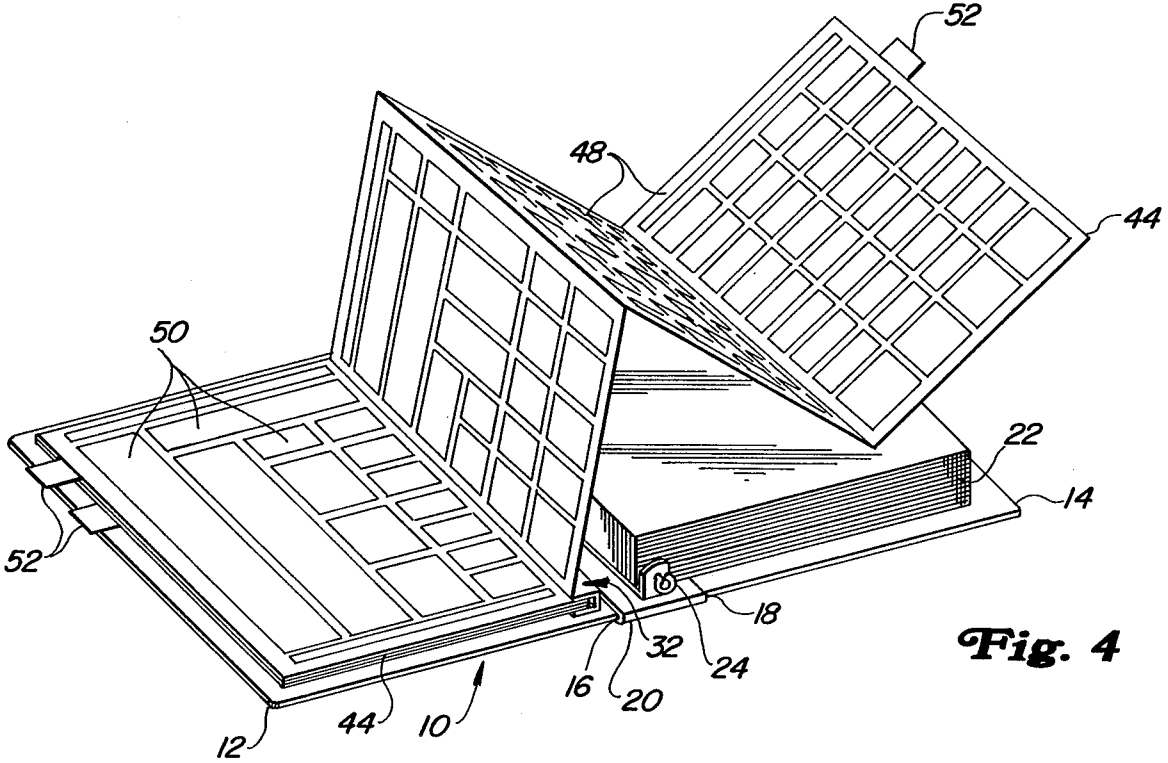
FIG. 4 is a perspective of the open binder showing the fold-out pages.

As best seen in FIG. 4, each sheet (44) may comprise a plurality of hingedly interconnected panels (48) which may be extended when the binder is opened and which of course may be refolded accordion fashion when the binder is closed. Each panel may contain labels (50) of various dimensions for bearing indicia or data supplementing that in the directory per se. Also spaces may be provided for the addition of labels to be added during extended use of the binder. Tabs (52) are provided on the sheets for further facilitating use of the binder.

Figure 2:
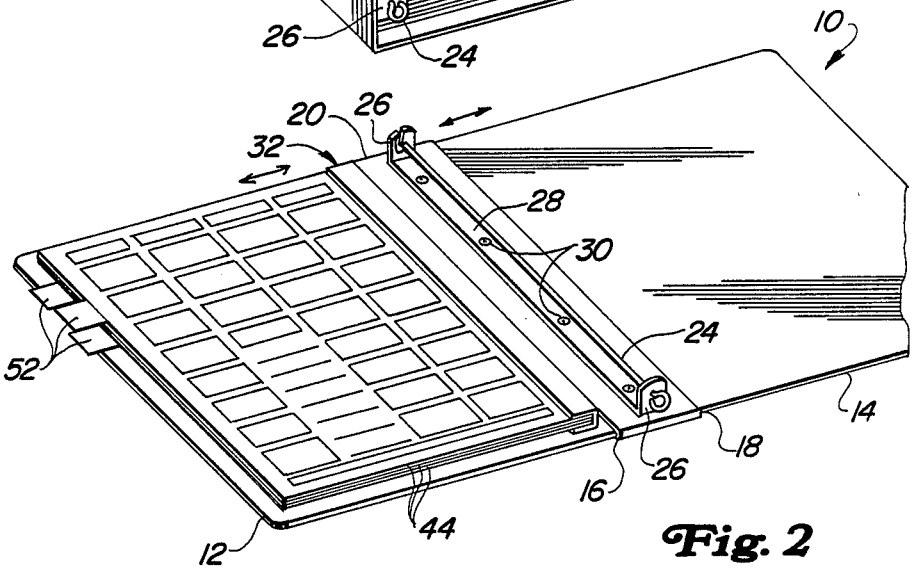
FIG. 2 is a perspective of the binder in opened state, with a portion omitted to conserve space.

At this juncture it should be noted that as indicated by the directional arrows in FIG. 2, the top (12) and bottom (14) covers of the binder (10) are moveably connected relative to the spine (20) such that the capacity of the binder (10) may be expanded and contracted in an adjustable manner for directories (22) having different thicknesses.

The manner of using the improved binder will have been clear from the foregoing description. Features and advantages other than those pointed out will become apparent to those versed in the art, as will many modifications in the preferred embodiment disclosed.

I claim:

1. For use with a telephone directory having pages of predetermined size, a binder having a spine and top and bottom covers attached to the spine and adapted to respectively overlie the top and bottom faces of the directory, means removably for attaching the binder to the directory, an auxiliary sheet folded in accordion fashion and disposed inside the binder top cover so as to normally lie atop the directory top face, the sheet having one edge disposed adjacent to the spine and adapted to be unfolded outwardly when the binder is opened so as to present an area several times greater than the predetermined size of the page in the directory, and means removably attaching the sheet to the binder along said one edge of the sheet.

2. The binder according to claim 1, in which the one edge of the sheet as well as the attaching means are parallel to the spine and the folds in the sheet are parallel to that edge.

3. The binder according to claim 1, in which the sheet, in its folded mode, has a portion remote from the attaching means, and exposed at a portion of the binder away from the spine, and tab means is attached to that portion and projects beyond the binder covers so as to enable manual unfolding of the sheet when the binder is opened.

4. The binder according to claim 1, including a like sheet carried by the binder between the bottom cover and the bottom face of the directory.

5. The binder according to claim 1, in which the attaching means comprises a channel affixed to the binder and having an open side receiving said one edge of the sheet.

6. The binder according to claim 5, in which the channel includes opposite legs spaced apart to provide the open side of the channel, at least one of said legs is flexible so as to be movable away from and back to the other leg so as to facilitate receipt of said one edge of the sheet.

7. The binder according to claim 6, in which the legs respectively have cooperative portions for removably receiving the sheet.

8. The binder according to claim 7, in which said one edge of the sheet has perforations therein and the cooperative portions of the channel legs include a plurality of peg means receiving the perforations.

9. The binder according to claim 8, in which each peg means includes a tubular member affixed to one leg and projecting toward the other leg and a prong affixed to and extending away from the other leg and tightly but separately received in the tubular member.

* * * * *